US008455801B2

(12) United States Patent
Ishiguro et al.

(10) Patent No.: US 8,455,801 B2
(45) Date of Patent: Jun. 4, 2013

(54) HEATING EQUIPMENT FOR A PLATE TO BE HEATED AND HEATING METHOD

(75) Inventors: Katsunori Ishiguro, Toyota (JP); Martin Pohl, Altenbeken (DE); Kiyohito Kondo, Toyota (JP)

(73) Assignees: Asian Takaoka Co., Ltd., Toyota-Shi, Aichi (JP); Benteler Automobiletechnik GmbH, Paderborn (DE)

( * ) Notice: Subject to any disclaimer, the term of this patent is extended or adjusted under 35 U.S.C. 154(b) by 387 days.

(21) Appl. No.: 12/812,871

(22) PCT Filed: Oct. 22, 2008

(86) PCT No.: PCT/JP2008/069117

§ 371 (c)(1),
(2), (4) Date: Jul. 14, 2010

(87) PCT Pub. No.: WO2009/093365

PCT Pub. Date: Jul. 30, 2009

(65) Prior Publication Data

US 2011/0042369 A1 Feb. 24, 2011

(30) Foreign Application Priority Data

Jan. 25, 2008 (JP) ..... 2008-014434

(51) Int. Cl.
*H01B 3/02* (2006.01)

(52) U.S. Cl.
USPC ..... 219/540; 219/539

(58) Field of Classification Search
USPC ..... 219/539, 540
See application file for complete search history.

(56) References Cited

U.S. PATENT DOCUMENTS 6,578,399 B1 6/2003 Haas et al.

FOREIGN PATENT DOCUMENTS

| | | | |
|---|---|---|---|
| JP | 13537 | | 1/1977 |
| JP | 59-165395 | A | 9/1984 |
| JP | 61-259482 | A | 11/1986 |
| JP | 1-146528 | U | 10/1989 |
| JP | 11-145166 | A | 5/1999 |
| JP | 2003-53437 | A | 2/2003 |
| JP | 2006-110549 | A | 4/2006 |

OTHER PUBLICATIONS

Official Action dated Dec. 17, 2010, issued by the Japanese Patent Office in corresponding Japanese Patent Application No. 2008-014434, and English translation of Official Action.
International Search Report mailed on Dec. 9, 2008 by the Japanese Patent Office as the International Searching Authority in International Application No. PCT/JP2008/069117.
Written Opinion mailed on Dec. 9, 2008 by the Japanese Patent Office as the International Searching Authority in International Application No. PCT/JP2008/069117.
English translation of the International Preliminary Report on Patentability issued Sep. 10, 2010 by the International Bureau of WIPO in International Application No. PCT/JP2008/069117.
Extended European Search Report issued on Dec. 6, 2012 by the European Patent Office in corresponding European Patent Application No. 08871425.8 (7 Pgs).

*Primary Examiner* — Samuel Gebremariam
(74) *Attorney, Agent, or Firm* — Buchanan Ingersoll & Rooney PC

(57) ABSTRACT

Provided are a quick heating equipment that is small sized, has a simple structure, consumes less energy, and is easy repairable and replaceable, and a quick heating method. The heating equipment of a plate material to be heated has a contact-heating surface configured by arranging a plurality of heating elements on heat-insulating base plates at predetermined intervals, in a planar fashion and in a predetermined pattern and the contact-heating surface(s) is/are directly contacted with the plate material to be heated for heating thereof.

14 Claims, 10 Drawing Sheets

HEATING EQUIPMENT FOR A PLATE TO BE HEATED AND HEATING METHOD

CROSS-REFERENCE TO RELATED APPLICATION

This application is based upon and claims the benefit of the priority of Japanese patent application No. 2008-014434 filed on Jan. 25, 2008, the disclosure of which is incorporated herein in its entirety by reference thereto.

TECHNICAL FIELD

The present invention relates to a heating equipment and a heating method for heating a plate material to be heated, and particularly the invention relates to a heating equipment and a heating method for heating a material to be heated by directly contacting a plurality of heating elements with the material to be heated.

BACKGROUND

A hot press-forming is a public technique to press a heated steel material in a hot state for forming automobile parts and the like. In addition, when quenching the material with a low-temperature press die(s) at the same time of the press-forming, it is possible to form a part that have excellent characteristics such as a high tensile strength and the like.

For heating a material, it is a common method to heat a material in a heating equipment such as a heating furnace, and the like; however, it will take approximately 3 to 5 minutes to heat a material up to 900 degrees C. in a heating furnace, for example, and the time is rather longer than a time required for a pressing step. It causes decrease in production efficiency because useless waiting time is necessary at the pressing step. Thus there is a demand to provide a method that can heat a material more rapidly.

One of methods for heating a material rapidly is a block heating method. This is a method to heat a steel plate material 21 to be heated, as shown in FIG. 10, by pressing and contacting a metal block 22, which have dimensions corresponding to the material 21 and is heated uniformly by electric heaters 20 provided therein, with the material 21 from an upper side. In particular, Patent Document 1 discloses a technique to contain a thermal diffusion plate inside a block to obtain a uniform temperature of a heating surface of the block as far as possible. Patent Document 2 discloses a heating equipment for heating a metal plate by transferring heat from a heat source such as a block heater to the metal plate via a heat conducting body.

[Patent Document 1] Japanese Patent Kokai Publication No. JP-A-11-145166

[Patent Document 2] Japanese Patent Kokai Publication No. JP-P2006-110549A

SUMMARY

The entire disclosures of the above Patent Documents 1 and 2 are incorporated herein by reference thereto. The analysis on the related art is set forth below by the present invention.

When heating a material up to 900 degrees C. or more using a block heating equipment, a cost of the equipment becomes very high because a material for the block is limited to that having a high melting point. Therefore, when heating a large part, it needs a large number of blocks and resulting in a high-cost heating equipment.

The block heating is a method to heat a steel plate by contacting a metal block, which is heated by heaters internally embedded, with the steel plate. A material for a block is limited to that causes small thermal deformation or distortion even when the block is heated up to high temperature so as to assure a tight contact of the block with a steel plate. In addition, the block should be in tight contact with embedded heaters so as to ensure heating of the block itself and therefore, it is necessary to machine and assemble the block and heaters with high accuracy and materials of less thermal deformation or distortion are required again for this point of view.

Since materials suitable for a block are limited due to its requirement for long time usage in high temperatures, it causes a high cost. In addition, such materials are generally difficult to machine, resulting in a high machining cost and fabrication cost. When heating a large part such as a structural part of an automobile, a large equipment is necessary and thus a cost for such an equipment becomes very high due to reasons above mentioned. On the other hand, such an equipment consumes much electric power since heaters should be switched on continuously to keep the block in high and uniform temperature, because it will take much time to heat the whole block up to high temperature from low temperature.

It is an object of the present invention to provide a rapid heating equipment having a small and simple structure, consuming less energy and being easy for repair and replacement and a method for rapid heating.

According to a first aspect of the present invention, there is provided a heating equipment for a plate material to be heated, wherein a contact-heating surface or surfaces is/are configured by arranging a plurality of heating elements at predetermined intervals, in a planar fashion and in a predetermined pattern on a base plate having a heat-insulating property, and the contact-heating surface(s) is/are directly contacted with the plate material to be heated for heating the plate material.

Preferably, the heating element is rod-shaped or strip-shaped with a rectangular section or rod-shaped with a circular or ellipsoidal section.

When the heating element has a rectangular section, preferably, a surface contacting with the plate material to be heated has a convex curved (profiled) surface along the whole length of the heating element.

Preferably, an insulation material is provided between the plurality of heating members and the insulation member is elastic or structured such that the insulation member can change its position in an orthogonal direction relative to the contact-heating surface.

Preferably, a plurality of the base plates, each having a heat-insulating property and configuring the contact-heating surface(s) by arranging the plurality of heating elements, is arranged on both sides of the plate material to be heated and the plate material is sandwiched by the base plates to make a direct contact with the contact-heating surface of the heating elements for heating the plate material.

Preferably, the plurality of heating elements arranged on both sides of the plate material to be heated are arranged alternately on both sides and such that orthogonal projections of the heating elements on both sides on a plane parallel to the base plates overlap partially each other.

Preferably, for overlapping the heating elements, the heating elements is arranged such that, in a case where the heating elements on the base plates on both sides are contacted with each other without the plate material to be heated, a contacting point corresponds to a cross point of convex curved surface portions and a line connecting both curvature centers of the convex curved surface portions of both of the heating elements near the contacting point.

Preferably, the base plate is configured by a plurality of units including a plurality of the heating elements.

Preferably, heating abilities of the plurality of heating elements can be controlled for every heating element or every unit, and can be determined in a desired heating pattern.

Preferably, the base plate is comprised of ceramics.

According to a second aspect of the present invention, there is provided a heating method for a plate material to be heated, which comprises: configuring a contact-heating surface or surfaces by arranging a plurality of heating elements at predetermined intervals, in a planar fashion and in a predetermined pattern on a base plate having a heat-insulating property, and providing the base plates on both sides of the plate material to be heated and sandwiching the plate material to make a direct contact with the contact-heating surface or surfaces of the heating elements for heating the plate material.

Effect of the Invention

According to the present invention, the equipment becomes small in size, simple in structure and low in cost because a block is eliminated (i.e., not used). It is possible to heat a material to be heated quickly because heating elements are directly contacted with a material. The equipment may be replaced by each unit and therefore repairs of the equipment become easy. A degree of freedom of heating is high because control of heating by each unit or each heating element may be possible. In addition, heating source may be off during a non-use period because the equipment can be heated in a short time and therefore, energy saving can be achieved.

BRIEF DESCRIPTION OF THE DRAWINGS

FIG. 2 shows schematic sectional views of an example 1 of the present invention.

FIG. 4 shows schematic sectional views of a heating equipment of an example 2 of the present invention.

Figure 1:
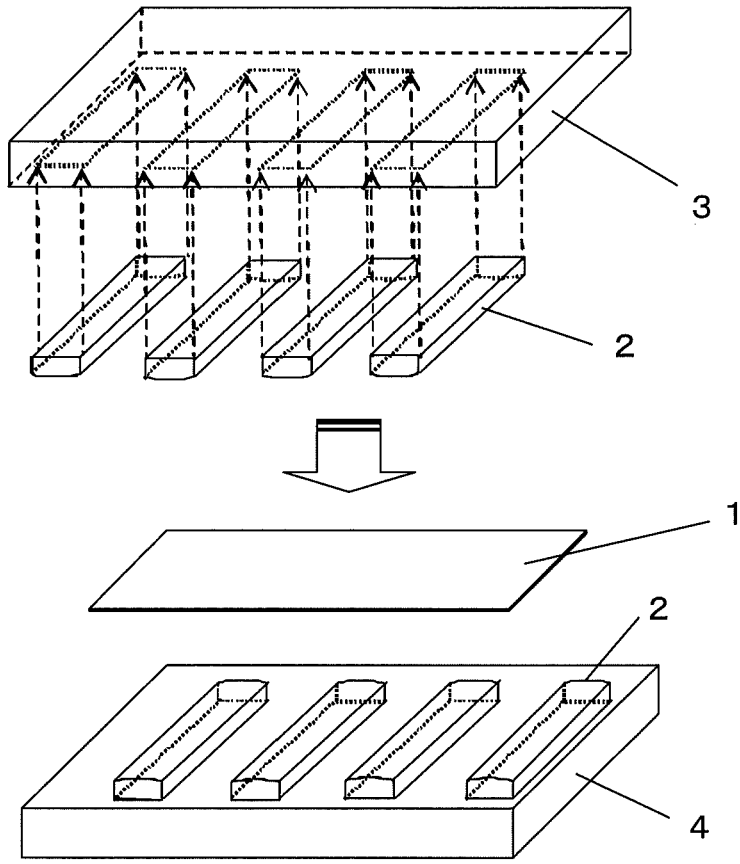
FIG. 1 illustrates a basic structure of a heating equipment of an example of the present invention.

As for explanation of signs, refer to the end of the description.

PREFERRED MODES

Two or more heating elements are arranged at specified intervals and in planar fashion on a base plate having a heat-insulating property. It is designated as a "unit". Ceramics etc. can be used for the base plate. The heating element has a rod-type or strip-type shape of a rectangular section or has a rod-type shape of a circular or oval (ellipsoidal) section, and the heating elements are arranged such that heating surfaces of the heating elements contacting with a material to be heated should contact with the material uniformly as a whole. When sections of the heating elements are rectangular, each contact surface with the material to be heated may be flat; however, more tight contact may be obtained by making the contact surfaces into convex curved surfaces and by press-contacting with load (or pressure). It is preferable that a ratio of a height of the convex curved surface to a width of the heating element has certain specified value. A contact-heating surface having a necessary heating area is obtained by arranging the one or more units in planar fashion.

The material to be heated is heated by directly contacting the contact-heating surface with the material. By this method the material to be heated can be rapidly heated efficiently. A width of the unit may range approximately 50 to 200 mm and a length may range approximately 100 to 1500 mm. A heating area which is necessary for a material to be heated can be obtained by combining sufficient number of the units. The area is not limited but may be, presumably, approximately 4000 mm×3000 mm at the largest.

Basically every kind of heating element may be used. A known heater such as an electric heater, sheath heater or gas heater (radiant tube heater), and the like may be used with respect to a temperature required. The heater is generally used having a rod-shape or strip-shape with a length, approximately, of 100 to 1500 mm and having a rectangular, round or oval section with one side length or diameter, approximately, of 5 to 200 mm.

Insulators are provided between heating elements. They have a role to heat a material to be heated uniformly by suppressing heat radiation from portions without heaters and, when the heating elements are arranged alternately on both sides, to make a tight contact of the heating elements and the material to be heated by pressing the material from opposite side of the heating element. In addition, they have an effect to make it easy to separate the material to be heated and the heating elements when the pressing force from the heating elements is released after heating. When heating elements are arranged alternately on both sides, heat insulation members have elasticity or a structure so as to change its vertical position or horizontal position, etc. so as to make the heating elements contact tight with a material to be heated when the heating elements ware press-contacted with the material to be heated. Glass wool or asbestos and the like is used for the heat insulation member.

A material to be heated may be heated from only one side. However, a plate material to be heated may be heated from both sides of the plate material by arranging a plurality of units on both sides and press-contacting the intervened plate material. Generally a material to be heated may be sandwiched from upside and downside; however, it may be possible to sandwich from right side and left side or in an oblique direction tilted from the up and down (vertical) direction or the right and left (horizontal) direction. A contact surface of a heating element with a material to be heated may be flat; however, the contact of the heating element with the material may become more secured by forming the contact surfaces of the heating elements in a convex curved (profiled) surface (convex curved surface portion) and press-contacting them against the material from both sides. In this case, the heating elements on both sides are arranged alternately. That is, heating elements are not arranged on regions where heating elements are arranged at corresponding opposite side and heating elements are arranged on regions where no heating element is arranged at corresponding opposite side. However, it is preferable to arrange the heating elements such that parts (edges) of the heating elements are overlapping each other. The "partial overlapping" means that when the heating elements on both sides are perpendicularly projected on a plane parallel to a base plate, the projected images overlap partially each other.

When arranging the heating elements partially overlapped, it is preferable to arrange such that the material to be heated should contact with at least one of the heating elements on both sides and that an area which contacts with the heating elements on both sides at the same time should be minimized. For this purpose the arrangement may be performed according the following concept. When contacting heating elements on both sides with each other without a material to be heated, both edge portions (correspond to edge portions of a section orthogonal to longitudinal axis of a rod-type heating element) of convex curved surface portions of the heating elements will contact with each other. The heating elements may be arranged such that a contacting point corresponds to a cross (intersection) point of a line connecting both curvature centers of convex curved surface portions (of both of the heating elements) containing the contacting point and the convex curved surface portion of the heating element.

An effect of uniform heating of whole material to be heated can be obtained by arranging the heating elements on both sides in partially overlapping manner in such a way, contacting whole of the material to be heated with at least one of the heating elements and reducing an area which contacts with the heating elements on both sides at the same time.

The present heating equipment has a heating control system that can control heating capacity of every heating element or every unit. Thus any heating patterns or heating temperatures can be freely selected according to sizes or shapes of a material to be heated. It contributes to energy saving because unnecessary heating elements are not heated up and heating of whole equipment can be turned off during a waiting time since it can be heated up quickly.

EXAMPLES

Example 1

FIG. 1 illustrates a basic structure of a heating equipment of an example of the present invention. A plate material (material to be heated) 1 made of a high-tensile steel, for example, is sandwiched from upside and downside by two base plates (upper base plate 3 and lower base plate 4) on which heaters (heating elements) 2 are arranged, and the plate material 1 is heated by the heaters 2 that biases the plate material 1 from upside and directly contacts with the plate material (press-contacting). The upper base plate 3 and the heaters 2 thereon are illustrated as an assembly drawing.

The heaters 2 of the example are sheath heaters having a rod shape. A section of each heater perpendicular to its longitudinal direction is nearly rectangular and a contacting surface with the plate material 1 has a convex curved (profiled) surface. The number of the heaters 2 is not limited; however, in this example, four heaters 2 are arranged in planar fashion (so as to contact with the plate material 1 uniformly) on each base plate. A base plate on which two or more heaters 2 are arranged is called as a unit and a unit on the upper side of the material to be heated is called as an upper unit 6 and a unit on the lower side of the material to be heated is called as a lower unit 7.

Figure 2A:
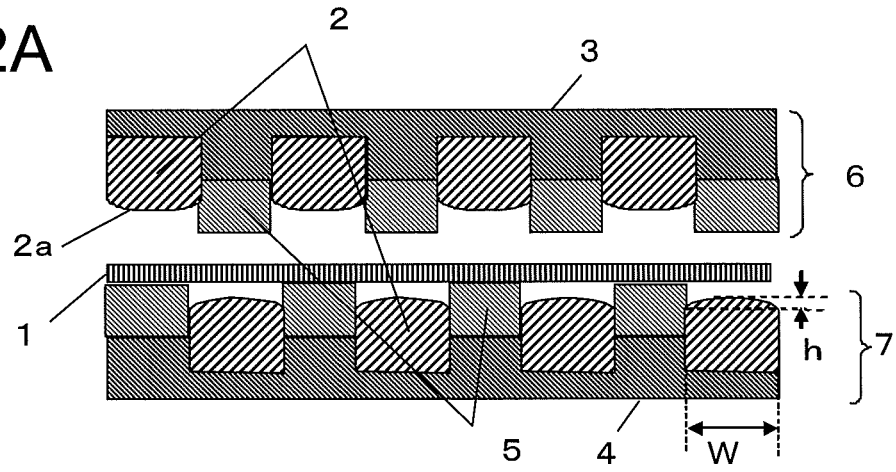
FIG. 2A shows a plate material before sandwiched by an upper unit and a lower unit and FIG. 2B shows the plate material after sandwiched by the upper and lower units.
Figure 2B:
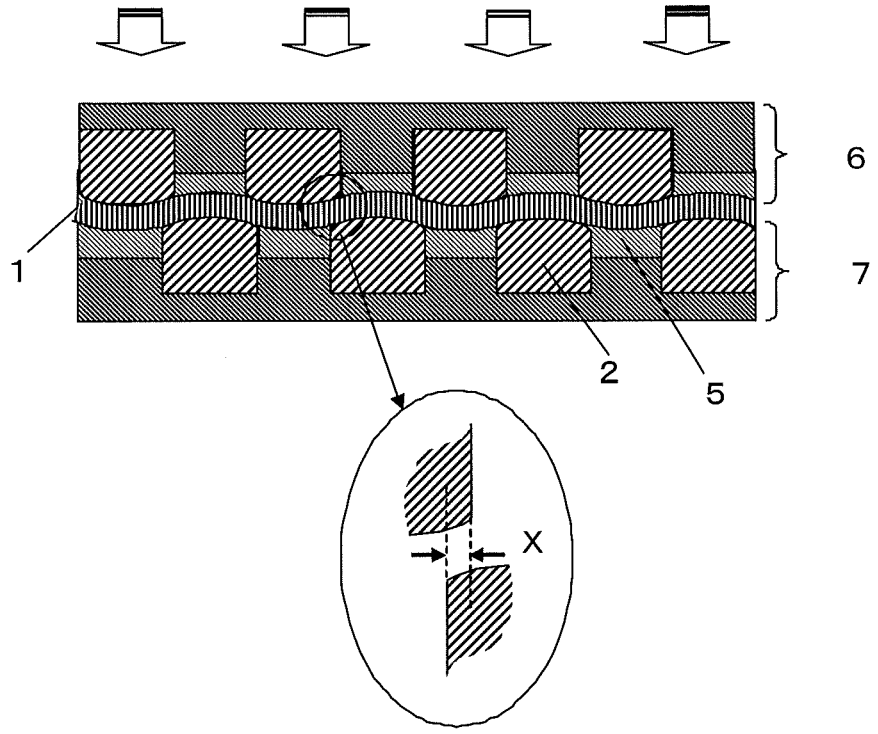

FIG. 2 shows schematic sectional views of the plate material 1 sandwiched between the upper and lower units 6 and 7, which are perpendicular to a longitudinal direction of the heater 2, and FIG. 2A shows a section before sandwiching and FIG. 2B shows a section after sandwiching. As shown in FIG. 2A, elastic heat insulation members 5 are arranged between the heaters 2 of each unit such that the elastic heat insulation members project from top surfaces (convex curved surface portion 2*a*) of the heaters 2. Glass wool or asbestos, for example, is used for a material of the heat insulation member 5. Purposes of the heat insulation member are, on the one hand, for heating the whole plate material 1 uniformly by heat-retaining a plate surface where the heater 2 is not contacted with and, on the other hand, for keeping sufficient contact of the plate material 1 with the heater 2 by pressing the plate material 1 from the opposite side of the heater 2. A contacting surface of the heater 2 and the plate material 1 is a convex curved surface portion 2*a* which curves gently.

As shown in FIG. 2, it is preferable to arrange a heater 2 at the one end of each unit and a heat insulation member 5 on the other end of the each unit. The heaters 2 and heat insulation members 5 can be arranged alternately as a whole without a gap thereby when a plurality of the units are combined.

FIG. 2B is a section in which the plate material 1 is sandwiched by the upper unit 6 from upper side with a pressing force. By a support of the curved contacting surface (convex curved surface portion 2*a*) of the heater 2 and the plate material 1, the plate material 1 curves along the convex curved surface portions 2*a* so as to contact with the heaters 2 without a gap when the plate material 1 is sandwiched by the units. At the same time, the heat insulation members 5 deform elastically along the plate material 1 and contact with the plate material 1, and thus the heat radiation is restrained and the plate material 1 is heated uniformly as a whole.

As shown in FIG. 2A, preferably the convex curved surface portion 2*a* of the heater 2 is formed such that a height "h" of the convex curved surface portion ranges 1 to 20% relative to a section width "W" of the heater 2, and particularly the ratio is preferably about 10%.

As shown in FIG. 2, the heaters 2 are arranged such that positions of the heaters of the upper and lower base plates are arranged alternately. It means that heat insulation members 5, instead of heaters 2, are located on the lower base plate 4 in regions where heaters 2 are located on the upper base plate 3, and heaters 2 are located on the lower base plate 4 in regions where insulation members 5, instead of heaters 2, are located on the upper base plate 3. Thereby the number of the heaters 2 can be minimized. As shown in an enlarged drawing (shown in an oval, provided that the plate material 1 is omitted) in FIG. 2B, however, it is preferable to arrange the upper and lower heaters partially (at a portion shown as "X" in the drawing) overlapped. The whole plate material 1 will contact with the heater at least one of the upper and lower heaters and can be heated uniformly as a whole.

Figure 3A:
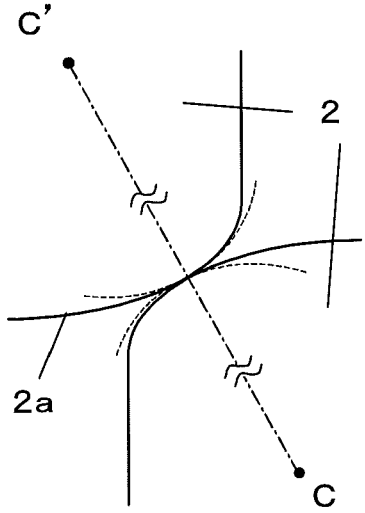
FIG. 3A shows a schematic sectional view of an example 1 indicating an arranging method of upper and lower heaters so as to overlap each other.
Figure 3B:
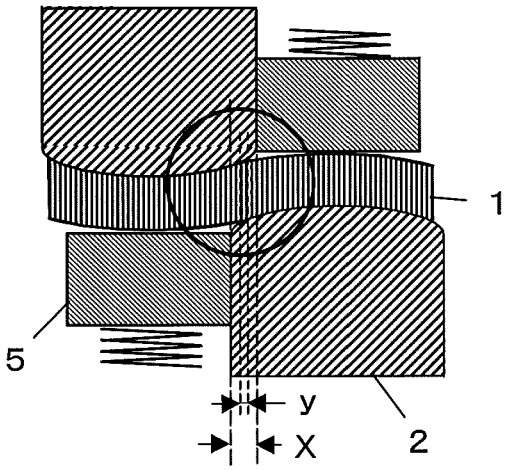
FIG. 3B shows a schematic sectional view indicating an area of a plate material which is in contact with both upper and lower heaters.
Figure 3C:
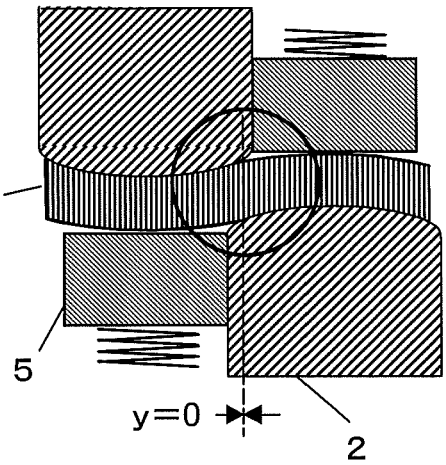
FIG. 3C shows a schematic sectional view indicating that an area of a plate material which is in contact with both upper and lower heaters is zero.

When arranging the heaters overlapped, it is preferable to arrange the heaters such that a region of the plate material 1 that contacts with the heaters 2 on both upper and lower sides should be minimized while the whole of the plate material 1 contacts with at least one heater 2 of the upper and lower heaters. FIG. 3B shows a schematic sectional view when the plate material 1 is sandwiched by the upper and lower heaters 2 that are arranged partially overlapped. The sign "X" indicates overlapping region of the heater and the sign "y" indicates a region, as shown in a circle in the drawing, where the plate material 1 contacts with both the upper and lower heaters 2. FIG. 3C shows a drawing in a case when the region "y" becomes zero as shown in a circle in the drawing, and this type of contact is desirable.

For this purpose, the heaters are arranged as follows. FIG. 3A shows a schematic sectional view when the upper and lower heaters 2 are contacted each other without the plate material 1 (material to be heated). A part of the convex curved surface portion 2*a* including a region around a contact point (edge portion of the heating element) is a curved surface having a some curvature as shown in a dotted line in the drawing and a center of curvature of the lower heater 2 is designated as C and a center of curvature of the upper heater 2 is designated as C'. The heaters are formed and arranged such that a cross (intersection) point of an imaginary segment line connecting the C and C' and convex curved surface portions 2*a* of the both heaters 2 registers with the contacting point.

Although a curved surface may be formed on the plate material 1 as a material to be heated because the contacting surface (convex curved surface portion 2*a*) of the heater 2 to the plate material 1 is curved, it does not become a problem because the curved surface of the plate material 1 is eliminated during a processing of the plate material 1 into a determined shape at a press step after heating.

Example 2

Figure 4A:
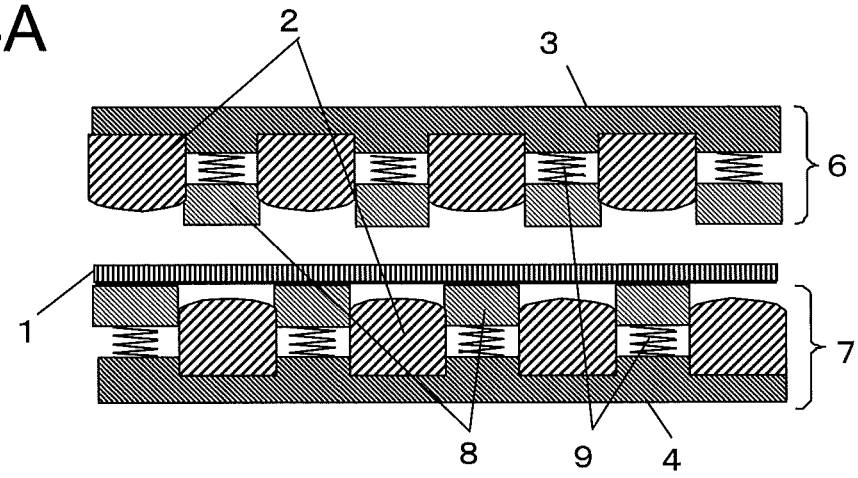
FIG. 4A shows a plate material before sandwiched by an upper unit and a lower unit and FIG. 4B shows the plate material after sandwiched by the upper and lower units.

FIG. 4 shows schematic sectional views of a heating equipment of an example 2 of the present invention. A different point from an example 1 is that heat insulation blocks 8 having no elasticity, instead of the elastic heat insulation member 5 arranged between the heaters 2, are elastically connected to the upper and lower base plates 3 and 4 by spring members 9 so as to be able to change positions of the heat insulation blocks 8 in a height direction (up and down, i.e., vertical direction). FIG. 4A shows a section illustrating the plate material 1 as a material to be heated before sandwiched by the upper and lower units 6 and 7 and the heat insulation blocks 8 are held by the spring members 9 at height positions projecting from the contacting surfaces of the heaters 2.

Figure 4B:
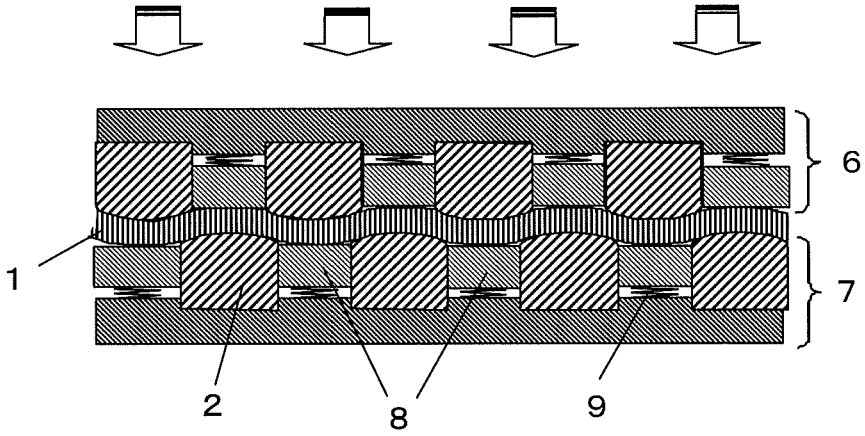

FIG. 4B shows a section illustrating the plate material 1 after sandwiched by the upper and lower units 6 and 7. The plate material 1 is press-contacted by the heaters 2 on both upper and lower sides and the heat insulation blocks 8 are pushed down (retracted) and are in contact with the plate material 1. Other structures are the same as an example 1 and, for example, the upper and lower heaters 2 are arranged slightly overlapped. Besides, a structure may be adopted in which holes are provided on the base plates 3 and 4 to connect the spring members 9 at the bottoms of the holes so as to be contracted and received in the holes for protecting the spring members 9 from the high temperature when the plate material is sandwiched (not shown).

Example 3

Figure 5:
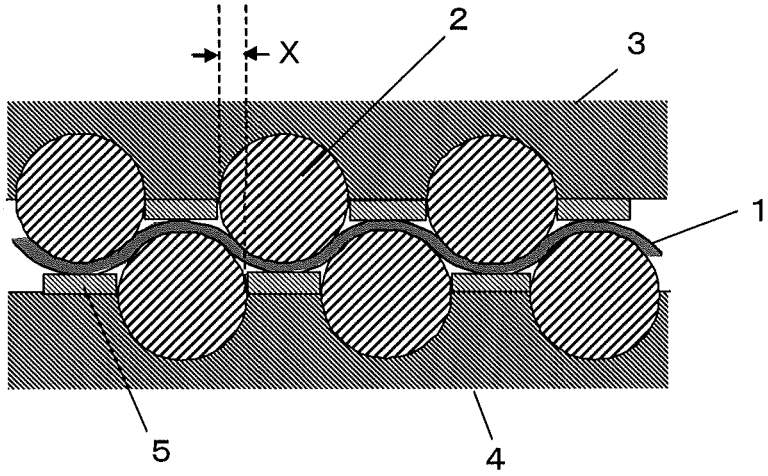
FIG. 5 shows a schematic sectional view of a heating equipment of an example 3 of the present invention.

FIG. 5 shows a schematic sectional view of a heating equipment (plate material 1 is heated) of an example 3 of the present invention in which a radiant tube heater having a circular section is employed as a heating element 2. A radiant tube heater 2 is a rod-type heat element having a circular section of a heating portion. A radiant tube heater having a diameter of approximately 200 mm is under practical use. This type of radiant tube heaters are arranged on the upper and lower base plates 3 and 4 alternately as shown in examples 1 and 2. The plate material 1 is heated by being sandwiched by the upper and lower radiant tube heaters 2. The radiant tube heaters 2 are arranged such that upper heaters and lower heaters are overlapped to some extent (indicated as "X" in FIG. 5) and the plate material 1 is in contact with at least one of the upper and lower radiant tube heaters 2 as a whole. Heat insulation members 5 are arranged between the radiant tube heaters 2 on each base plate so that the whole plate material 1 can be heated uniformly.

Example 4

Figure 6:
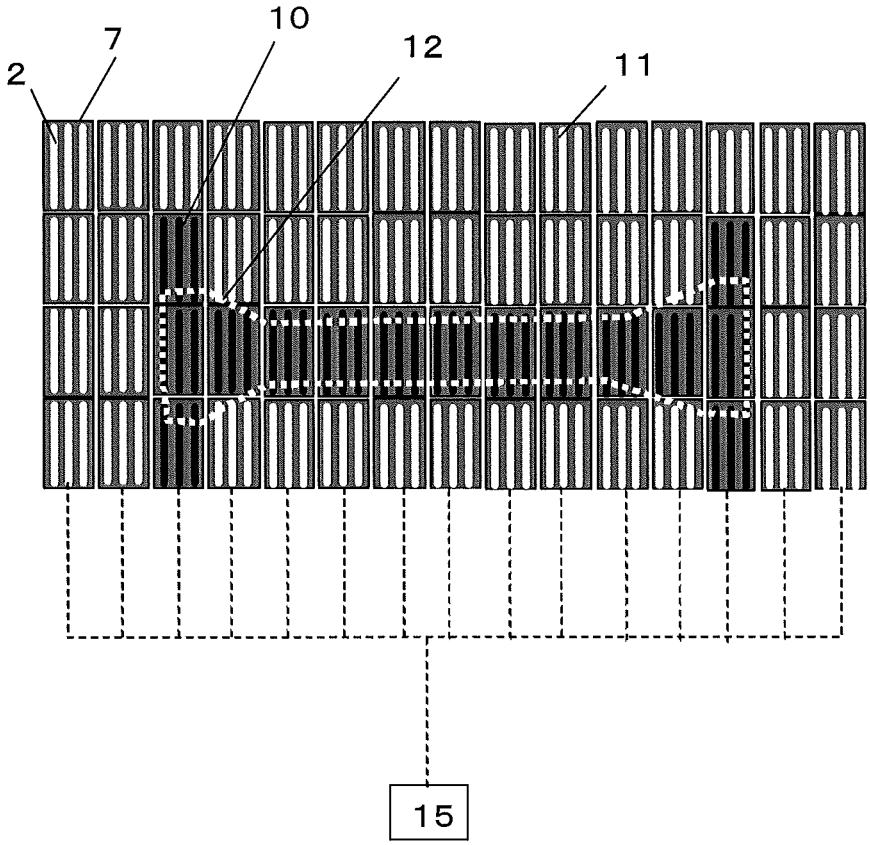
FIG. 6 shows a schematic drawing of a heating equipment of an example 4 of the present invention indicating a structure and a mode of use.

The heating equipment according to the present invention can form a wide heating area by arranging a plurality of base plates (units) each having two or more heating elements. Further, a heating ability (capacity) may be controlled by every heater or every unit using a heating control system 15 according to a size or shape of a material to be heated. FIG. 6 shows a schematic drawing of a heating equipment of an example 4 of the present invention indicating a structure and a mode of use. In this example 4, one heating equipment is configured by arranging four lower units 7 in a longitudinal direction and fifteen lower units 7 in transverse direction, in each unit three heaters 2 are arranged on a base plate.

In FIG. 6, hot (heat-radiating) heaters 10 are shown by black and thick lines and cool (non heat-radiating) heaters 11 are shown by white lines in case of heating a steel plate (material to be heated) 12 for forming a door beam as a part for a vehicle. A shape of the steel plate (material to be heated) 12 for the door beam is shown by white in a dotted line. Only an area necessary for heating according to the size and shape of the steel plate (material to be heated) 12 for the door beam can be heated as shown in the drawing.

Although only an arrangement of lower units 7 is shown in FIG. 6, upper units 6 corresponding to the lower units 7 may be arranged and used by combining them as explained above in examples 1 to 3. Such a combination can be applied in the following examples.

Example 5

Figure 7:
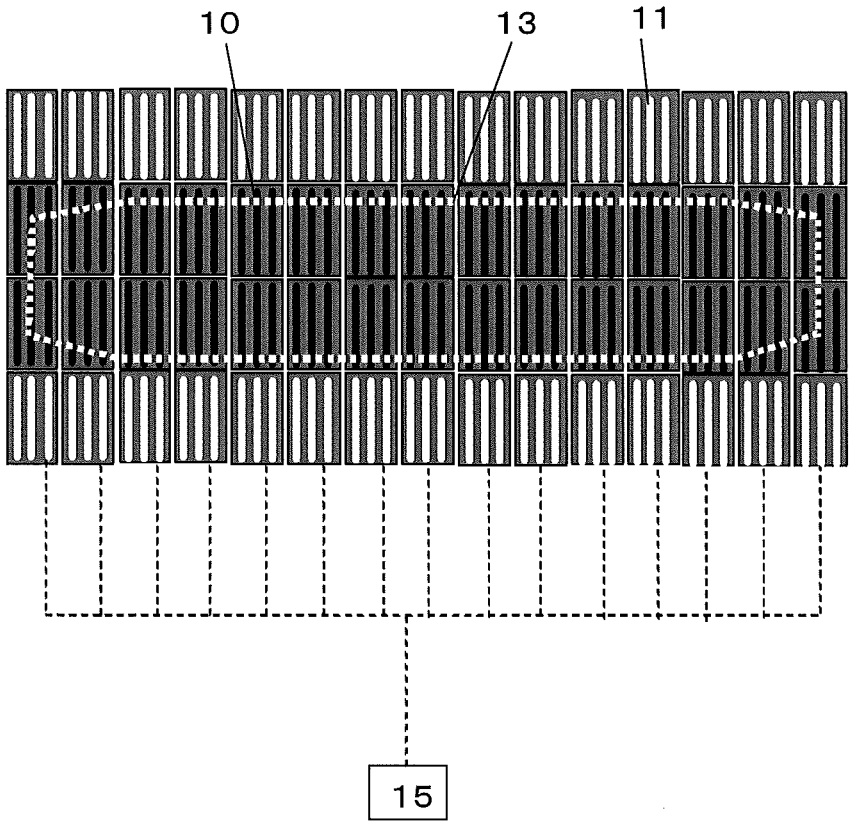
FIG. 7 shows a schematic drawing of a heating equipment of an example 5 of the present invention indicating a mode of use.

FIG. 7 shows an arrangement of heaters 2 when heating a different material to be heated (steel plate for forming a bumper) 13 using a heating equipment in which four units are arranged in longitudinal direction and fifteen units are arranged in a transverse direction, arranging three heaters 2 on a base plate of each unit as explained in example 4. Also, hot heaters 10 are shown in black and thick lines and cool heaters 11 are shown in white lines. A shape of the steel plate for a bumper (material to be heated) 13 is shown in a white and dotted line.

Example 6

Figure 8:
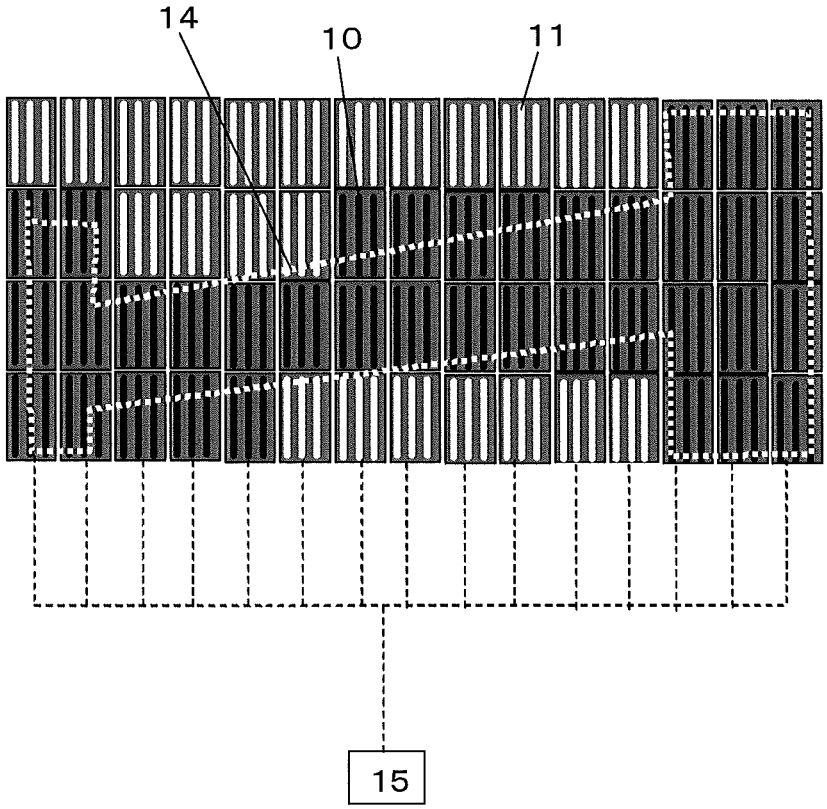
FIG. 8 shows a schematic drawing of a heating equipment of an example 6 of the present invention indicating a mode of use.

FIG. 8 shows a heating area of the same heating equipment as examples 4 and 5 for heating a different material to be heated (steel plate for forming a B-pillar) 14 using the heating equipment. Also, hot heaters 10 are shown in black and thick lines and cool heaters 11 are shown in white lines. A shape of the steel plate for a B-pillar (material to be heated) 14 is shown in a white and dotted line.

Example 7

Figure 9:
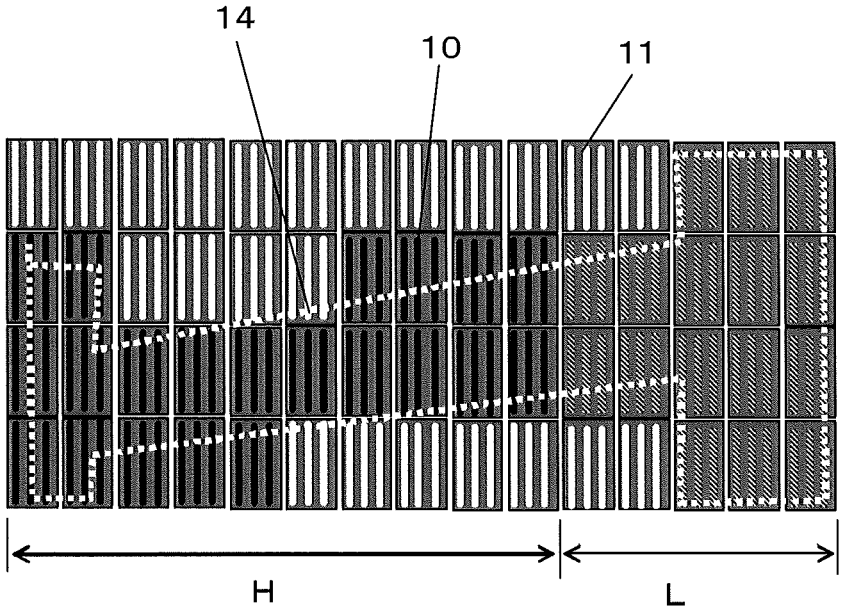
FIG. 9 shows a schematic drawing of a heating equipment of an example 7 of the present invention indicating a mode of use.
Figure 10:
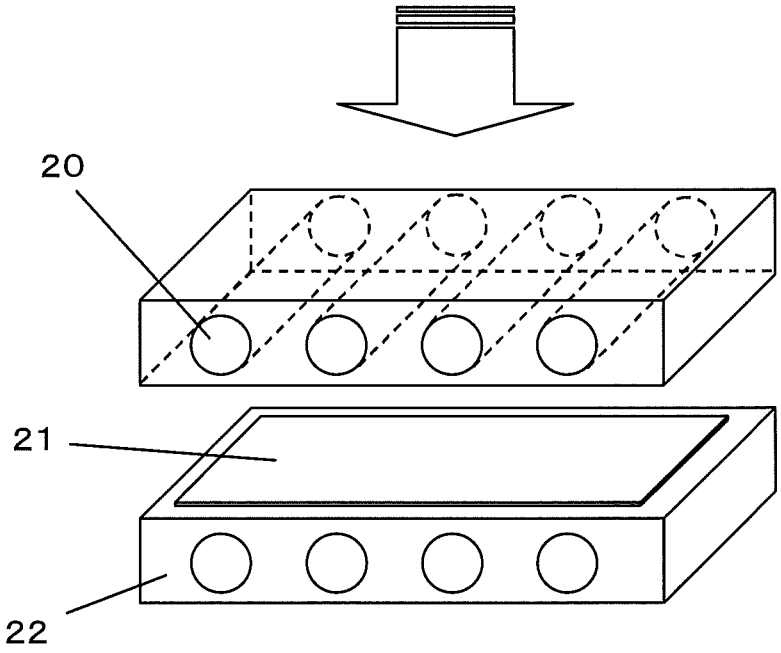
FIG. 10 shows a conventional block heating equipment.

The heating equipment of the present invention is applicable in the case where a part of a material should be heated at a higher temperature and the other part of the material may be heated at a lower temperature. FIG. 9 shows a heating area in the case that the degree of heating is changed from example 6 by each heater 2 (or unit) (heating control system 15 is not shown). FIG. 9 shows an example in which (a part of heaters of) units arranged at right side by four in the longitudinal direction and by five in the transverse direction (indicated by slanting lines) are heated at a relatively low temperature that is lower than A1 transformation temperature of a steel (designated as L) and (a part of heaters of) the other parts of the units (indicated by black lines) are heated at a relatively high temperature that is higher than the A1 transformation temperature of a steel (designated as H) and that the steel can be quenched. As described above a material to be heated can be heated by any desirable heating pattern and any heating temperature according to a position or a shape of the material to be heated.

Although the present invention has been elucidated by way of the disclosed exemplary embodiment, which are not restrictive to the present invention, and modes or examples of the invention can be modified or adjusted according to the person skilled in the art within the entire disclosure of the present invention.

(Explanation Of Reference Signs)

1 plate material (to be heated)
2 heater (heating element)
2*a* convex curved surface portion
3 upper base plate
4 lower base plate
5 heat insulation member
6 upper unit
7 lower unit
8 heat insulation block
9 spring member
10 heat-radiating heater
11 non heat-radiating heater
12 steel plate for door beam (material to be heated)
13 steel plate for bumper (material to be heated)
14 steel plate for B-pillar (material to be heated)
15 heating control system
20 electric heater
21 steel part
22 block

The invention claimed is:

1. A heating equipment for plate material to be heated, wherein a contact-heating surface or surfaces is/are configured by arranging a plurality of heating elements at predetermined intervals, in a planar fashion and in a predetermined pattern on a base plate having a heat-insulating property, and the contact-heating surface(s) is/are directly contacted with the plate material to be heated for heating thereof;

wherein the heating element is rod-shaped or strip-shaped with a rectangular section, or rod-shaped with a circular or ellipsoidal section; and wherein a surface of the heating element contacting with the plate material to be heated has a convex curved surface along the whole length of the heating element in a case where the heating element has a rectangular section.

2. A heating equipment for plate material to be heated, wherein a contact-heating surface or surfaces is/are configured by arranging a plurality of heating elements at predetermined intervals, in a planar fashion and in a predetermined pattern on a base plate having a heat-insulating property, and the contact-heating surface(s) is/are directly contacted with the plate material to be heated for heating thereof; and wherein insulation members are provided between the plurality of heating elements, the insulation member having elasticity or capability of changing position thereof in an orthogonal direction relative to the contact-heating surface.

3. A heating equipment for plate material to be heated, wherein a contact-heating surface or surfaces is/are configured by arranging a plurality of heating elements at predetermined intervals, in a planar fashion and in a predetermined pattern on a base plate having a heat-insulating property, and the contact-heating surface(s) is/are directly contacted with the plate material to be heated for heating thereof; and wherein a plurality of the base plates, each having a heat-insulating property and configuring the contact-heating surface(s) by arranging the plurality of heating elements, is arranged on both sides of the plate material to be heated and the plate material is sandwiched by the base plates to make a direct contact with the contact-heating surface of the heating elements for heating the plate material.

4. The heating equipment according to claim 3, wherein the base plate is configured by a plurality of units comprising a plurality of the heating elements.

5. The heating equipment according to claim 4, wherein heating abilities of the plurality of heating elements can be controlled for every heating element or every unit, and can be determined in a desired heating pattern.

6. The heating equipment according to claim 3, wherein the base plate comprises ceramics.

7. A heating equipment for plate material to be heated, wherein a contact-heating surface or surfaces is/are configured by arranging a plurality of heating elements at predetermined intervals, in a planar fashion and in a predetermined pattern on a base plate having a heat-insulating property, and the contact-heating surface(s) is/are directly contacted with the plate material to be heated for heating thereof;

wherein a plurality of the base plates, each having a heat-insulating property and configuring the contact-heating surface(s) by arranging the plurality of heating elements, is arranged on both sides of the plate material to be heated and the plate material is sandwiched by the base plates to make a direct contact with the contact-heating surface of the heating elements for heating the plate material; and wherein the plurality of heating elements arranged on both sides of the plate material to be heated are arranged alternately on both sides and such that orthogonal projections of the heating elements on both sides on a plane parallel to the base plates overlap partially each other.

8. A heating equipment for plate material to be heated, wherein a contact-heating surface or surfaces is/are configured by arranging a plurality of heating elements at predetermined intervals, in a planar fashion and in a predetermined pattern on a base plate having a heat-insulating property, and the contact-heating surface(s) is/are directly contacted with the plate material to be heated for heating thereof;

wherein a plurality of the base plates, each having a heat-insulating property and configuring the contact-heating surface(s) by arranging the plurality of heating elements, is arranged on both sides of the plate material to be heated and the plate material is sandwiched by the base plates to make a direct contact with the contact-heating surface of the heating elements for heating the plate material;

wherein the plurality of heating elements arranged on both sides of the plate material to be heated are arranged alternately on both sides and such that orthogonal projections of the heating elements on both sides on a plane parallel to the base plates overlap partially each other; and wherein the heating elements are arranged such that, in a case where the heating elements on the base plates on both sides are contacted with each other without the plate material to be heated, a contacting point corresponds to a cross point of convex curved surface portions and a line connecting both curvature centers of convex curved surface portions of both of the heating elements near the contacting point.

9. A heating method for a plate material to be heated, comprising:

configuring a contact-heating surface by arranging a plurality of heating elements at predetermined intervals, in a planar fashion and in a predetermined pattern on a base plate having a heat-insulating property, and the contact-heating surface is directly contacted with the plate material to be heated for heating thereof, and providing a plurality of the base plates, each having a heat-insulating property and configuring the contact-heating surface by arranging the plurality of heating elements, on both sides of the plate material to be heated and sandwiching the plate material between the base plates to make a direct contact with the contact-heating surface or surfaces of the heating elements for heating the plate material.

10. The method for producing a press-formed material, comprising heating by using the heating method according to claim 9.

11. A heating method for a plate material to be heated, comprising:

configuring a contact-heating surface by arranging a plurality of heating elements at predetermined intervals, in a planar fashion and in a predetermined pattern on a base plate having a heat-insulating property, wherein a surface of the heating element contacting with the plate material to be heated has a convex curved surface along the whole length of the heating element in a case where the heating element has a rectangular section; and providing the base plates on both sides of the plate material to be heated and sandwiching the plate material to make a direct contact with the contact-heating surface or surfaces of the heating elements for heating the plate material.

12. The method for producing a press-formed material, comprising heating by using the heating method according to claim 11.

13. A heating method for a plate material to be heated, comprising:

configuring a contact-heating surface by arranging a plurality of heating elements at predetermined intervals, in a planar fashion and in a predetermined pattern on a base plate having a heat-insulating property;

providing insulation members between the plurality of heating elements, the insulation member having elasticity or capability of changing position thereof in an orthogonal direction relative to the contact-heating surface; and providing the base plates on both sides of the plate material to be heated and sandwiching the plate material to make a direct contact with the contact-heating surface or surfaces of the heating elements for heating the plate material.

14. The method for producing a press-formed material, comprising heating by using the heating material according to claim 13.

* * * * *